US009175506B2

(12) United States Patent
Bauman

(10) Patent No.: US 9,175,506 B2
(45) Date of Patent: Nov. 3, 2015

(54) ADJUSTABLE LOCK POINT FOR LOCK TIE BARS

(71) Applicant: Truth Hardware Corporation, Owatonna, MN (US)

(72) Inventor: Leonard P. Bauman, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 9 days.

(21) Appl. No.: 13/844,661

(22) Filed: Mar. 15, 2013

(65) Prior Publication Data

US 2014/0265364 A1 Sep. 18, 2014

(51) Int. Cl.
*E05C 1/06* (2006.01)
*E05C 3/12* (2006.01)
*E05C 3/00* (2006.01)

(52) U.S. Cl.
CPC . *E05C 3/12* (2013.01); *E05C 3/004* (2013.01); *Y10T 292/1043* (2013.01)

(58) Field of Classification Search
CPC ..... E05C 3/12; E05C 3/004; E05C 9/1858; Y10T 292/1043; E05B 63/0056
USPC ..... 292/32, 33, 34, 37, 38, 40, 42, 137, 292/138, 140, 145, 194, DIG. 20, DIG. 47; 49/394, 395
See application file for complete search history.

(56) References Cited

U.S. PATENT DOCUMENTS

| | | | | |
|---|---|---|---|---|
| 1,385,102 | A | | 7/1921 | Winters et al. |
| 2,548,578 | A | | 4/1951 | Andersson et al. |
| 3,949,525 | A | | 4/1976 | Bates et al. |
| 4,059,298 | A | | 11/1977 | Van Klompenburg |
| 4,148,106 | A | | 4/1979 | Gallien |
| 4,429,910 | A | | 2/1984 | Anderson |
| 4,444,294 | A | * | 4/1984 | Yoshigai ..... 188/24.11 |
| 4,602,457 | A | | 7/1986 | Kreusel |
| 4,621,847 | A | | 11/1986 | Paulson et al. |
| 4,739,583 | A | | 4/1988 | Toensmann et al. |
| 4,803,808 | A | * | 2/1989 | Greisner ..... 49/394 |
| 4,980,946 | A | | 1/1991 | Verasani et al. |
| 4,991,886 | A | | 2/1991 | Nolte et al. |
| 5,045,265 | A | | 9/1991 | Pettit |
| 5,087,087 | A | | 2/1992 | Vetter et al. |
| 5,118,145 | A | | 6/1992 | Tucker |
| 5,318,333 | A | | 6/1994 | Dreifert |
| 5,370,428 | A | | 12/1994 | Dreifert et al. |
| 5,603,538 | A | | 2/1997 | Evers |
| 5,642,909 | A | | 7/1997 | Swan et al. |
| D388,689 | S | | 1/1998 | Bauman et al. |
| D390,445 | S | | 2/1998 | Johnson et al. |
| 5,741,031 | A | | 4/1998 | Bauman et al. |
| 5,778,602 | A | | 7/1998 | Johnson et al. |

(Continued)

FOREIGN PATENT DOCUMENTS

| | | | |
|---|---|---|---|
| AT | 508560 A4 | * | 2/2011 |
| DE | 10158359 A1 | * | 6/2003 |
| GB | 2456762 A | * | 7/2009 |

*Primary Examiner* — Kristina Fulton
*Assistant Examiner* — Christine M Mills
(74) *Attorney, Agent, or Firm* — Patterson Thuente Pedersen, P.A.

(57) ABSTRACT

A lock system for casement or awning windows. The lock system includes a keeper and a tie bar with a rivet assembly rotatably attached thereto. The rivet assembly includes a rivet and a sleeve rotationally fixed to the rivet, the rivet and the sleeve having longitudinal axes parallel to but offset from each other.

16 Claims, 5 Drawing Sheets

(56) References Cited

U.S. PATENT DOCUMENTS

| | | | | |
|---|---|---|---|---|
| 5,794,310 | A * | 8/1998 | Dallmann | 16/362 |
| 5,839,767 | A | 11/1998 | Piltingsgrud | |
| 5,927,767 | A | 7/1999 | Smith et al. | |
| 6,135,511 | A | 10/2000 | Smith et al. | |
| 6,161,881 | A | 12/2000 | Babka et al. | |
| 6,367,853 | B1 | 4/2002 | Briggs | |
| 6,477,810 | B2 | 11/2002 | Van De Keuken | |
| 6,651,389 | B2 * | 11/2003 | Minter et al. | 49/394 |
| 6,837,004 | B2 | 1/2005 | Annes | |
| 7,004,515 | B2 | 2/2006 | Timothy | |
| 7,014,227 | B2 | 3/2006 | Strangward et al. | |
| 7,219,469 | B2 | 5/2007 | DiFrancesco | |
| 7,452,014 | B2 | 11/2008 | Vetter | |
| 7,617,707 | B2 | 11/2009 | Chiang | |
| 7,624,539 | B2 | 12/2009 | Speyer et al. | |
| 7,627,987 | B2 | 12/2009 | Thielmann et al. | |
| 7,665,245 | B2 | 2/2010 | Speyer et al. | |
| 7,685,774 | B2 | 3/2010 | Thielmann | |
| 7,685,775 | B2 | 3/2010 | Speyer et al. | |
| 7,685,776 | B2 | 3/2010 | Speyer et al. | |
| 7,707,773 | B2 | 5/2010 | Thielmann et al. | |
| 7,708,322 | B2 | 5/2010 | Timothy et al. | |
| 7,823,935 | B2 | 11/2010 | Norris et al. | |
| 7,946,633 | B2 * | 5/2011 | Minter | 292/23 |
| 8,333,413 | B2 | 12/2012 | Bourgoin et al. | |
| 8,353,541 | B2 | 1/2013 | Minter | |
| 8,448,996 | B2 | 5/2013 | Lake et al. | |
| 8,640,384 | B2 | 2/2014 | Curtis | |
| 2006/0088398 | A1 * | 4/2006 | Lund | 411/155 |
| 2012/0000451 | A1 * | 1/2012 | Grace | 124/25.6 |

* cited by examiner

ADJUSTABLE LOCK POINT FOR LOCK TIE BARS

FIELD OF THE INVENTION

The present invention relates to casement and awning window lock systems and, more specifically, to devices for adjusting the amount of pull-in of the window sash to the window frame when the lock system is actuated.

BACKGROUND OF THE INVENTION

A casement or an awning window generally refers to a sash that is attached to its frame by one or more hinges. The hinges can be located on any side of the sash and the frame though generally not on the lower edge of the sash and frame. In general, a casement window rotates along a vertical axis (the hinges of a casement window defining a vertical rotation axis), while an awning window rotates along a horizontal axis (the hinges of an awning window defining a horizontal rotation axis). Most casement and awning windows which employ the use of a crank lever or cam handle operator open outwardly so as not to interfere with the operator of the window.

In a casement or awning window, a lock system is generally provided on the non-hinge side where the window sash meets the window frame. In some configurations, a tie bar having at least one rivet is provided in the frame and at least one keeper is provided on the sash. When the window is in the closed position, the keeper is adjacent to the rivets. The window operator then moves the tie bar via a drive assembly causing the rivets to engage with the keeper. This engagement pulls-in the window sash to the window frame thus providing a sufficient seal between the frame and sash and locking the window.

However, due to variations in window manufacturing and in field installations, it has been observed that the engagement of the rivet with the keeper may not be as precise as possible resulting in a less than satisfactory seal between the frame and sash. Prior attempts have been made toward providing adjustability of the rivet or the keeper, such as disclosed in U.S. Pat. No. 6,651,389, said patent being hereby fully incorporated herein by reference. These prior attempts, however, have not been entirely satisfactory. Therefore, there still exists a need for a window lock system that allows for easy adjustment resulting in a satisfactory seal between the sash and frame.

SUMMARY OF THE INVENTION

The present invention is an improved sash lock system for casement or awning windows that addresses the aforementioned needs of the industry. Throughout this application structures may be referred to as being associated with a window sash or frame for convenience of description. It is to be understood that the embodiments of the invention described herein can generally be reversed so that the sash component can be attached to the frame and/or the frame component can be secured to the sash. Accordingly, the fact that this specification refers to a sash component or a frame component should not be considered limiting to the inventions disclosed herein.

A lock system for casement or awning windows is described herein. The lock system includes at least one rivet assembly rotatably attached to a tie bar and at least one keeper for receiving the rivet. The rivet assembly includes a rivet with a shank and an enlarged head, and a cylindrical sleeve. The shank of the rivet is received through the sleeve at a location offset from the center axis of the cylindrical sleeve. The shank of the rivet is symmetrical relative to the head, and may have a square, hexagonal, or other polygonal cross-section so that the sleeve is not rotatable on the shank of the rivet. Rotation of the rivet assembly relative to the tie bar causes the center axis of the sleeve relative to a center line of the tie bar. Hence, the rivet assembly can be adjusted as desired to pull the sash in or out of the frame when the rivet engages the keeper, in order to increase or decrease the seal between the frame and sash.

According to one embodiment of the invention, at least one rivet assembly having a rivet and a sleeve is rotatably attached to a tie bar. The sleeve is generally cylindrical having a longitudinal through hole with a geometric center positioned eccentrically in relation to the longitudinal axis of the sleeve. The through hole fittingly engages with the shank of the rivet so that the sleeve is not rotatable relative to the shank.

In one embodiment, the through hole and shank have matching cross sections and are square, hexagonal, or polygonal. In other embodiments, the through hole and shank have matching cross sections and shapes including, for example, star, oval, triangular, etc.

In one embodiment, the shank and through hole are shaped so that they can only assemble in one orientation. In one embodiment, the shank and through hole are shaped so that the sleeve offset is oriented to match an indicator mark on the head of the rivet.

In an embodiment of the invention, the sleeve is positioned on the shank so that the sleeve is positioned between the tie bar and the head of the rivet.

In one embodiment, the distal end of the shank fittingly engages with a hole that is provided on the tie bar so that the rivet can be rotated for adjustment. Friction created at the juncture of the shank and tie bar allow the rivet to be rotated with a tool and maintain its position during normal operation of the locking system.

In an embodiment, the rivet and shank are centered along a longitudinal axis, where the longitudinal axis is parallel to and offset from the longitudinal axis of the sleeve such that the proximal end of the sleeve is offset relative to the bottom of the head.

In one embodiment, the head of the rivet can be shaped to complement and mate with a wrench or other tool. In another embodiment, the head is provided with a recess shaped to receive a tool that is inserted into the recess to rotate the rivet assembly. The shaped recess can include, but is not limited to, a hex shape, a star shape, a torx, a spanner, an allen, a square shape, a cross shape, a Phillips, and a slot shape.

In certain embodiments, a dimple or other similar feature can be provided on the head to indicate the direction of the offset of the sleeve.

In an embodiment, a casement window includes a frame, a sash operably received in the frame, and a lock assembly for locking the sash in the frame. The lock assembly includes a tie bar operably coupled to the frame, the tie bar having a rotatable rivet assembly thereon, the rotatable rivet assembly including a rivet having a head portion and a shank portion, and a sleeve received on the shank, the sleeve being substantially cylindrical about a sleeve axis, the head portion and the shank portion of the rivet being symmetrical about a rivet axis, the shank portion received through an aperture in the sleeve so that the rivet axis is offset from the sleeve axis and the sleeve is rotationally fixed relative to the rivet. The lock assembly further includes a keeper on the sash, the tie bar being selectively operable to engage the rivet assembly with the keeper to secure the sash to the frame.

In an embodiment the rivet shank has a polygonal cross-sectional shape and the aperture in the sleeve has a corresponding polygonal cross-sectional shape. The polygonal cross-sectional shape can be a square or a hexagon.

In an embodiment, the head portion of the rivet is round, square, or hexagonal. In a further embodiment, the head portion of the rivet has a recess for receiving a tool to rotate the rivet assembly.

In an embodiment, a window lock assembly includes a tie bar having a rotatable rivet assembly thereon, the rotatable rivet assembly including a rivet having a head portion and a shank portion, and a sleeve received on the shank, the sleeve being substantially cylindrical about a sleeve axis, the head portion and the shank portion of the rivet being symmetrical about a rivet axis, the shank portion received through an aperture in the sleeve so that the rivet axis is offset from the sleeve axis and the sleeve is rotationally fixed relative to the rivet.

BRIEF DESCRIPTION OF THE DRAWINGS

The invention may be more completely understood in consideration of the following detailed description of various embodiments of the invention in connection with the following drawings, in which.

Figure 1:
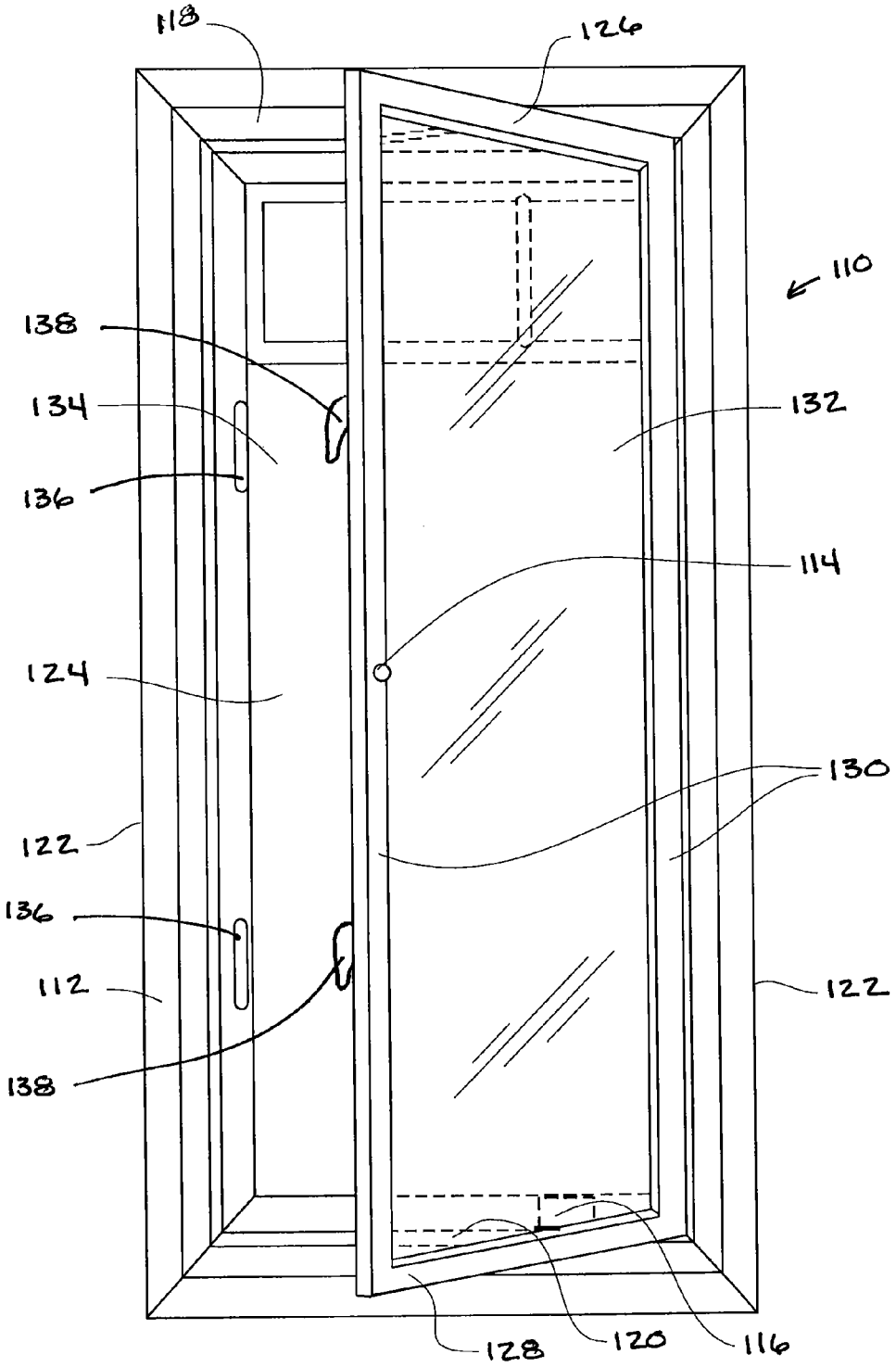
FIG. 1 is an isometric view of a casement window.

While the present invention is amenable to various modification and alternative forms, specifics thereof have been shown by way of example in the drawings and will be described in detail. It should be understood however, that the intention is not to limit the invention to the particular embodiments described. On the contrary, the intention is to cover all modifications, equivalents, and alternatives falling within the spirit and scope of the invention. In particular, although the invention is primarily described in the context of a casement window, the invention is equally applicable in the context of an awning window.

DETAILED DESCRIPTION

One embodiment of a casement window 110 is depicted in FIG. 1. Casement window 110 generally includes frame 112, sash 114, and operator mechanism 116. Frame 112 includes head jamb 118, sill 120, and sides 122 and defines window opening 124. Sash 114 includes top rail 126, bottom rail 128, side rails 130, and window pane 132. Sash 114 may also include screen 134. Sash 114 is typically coupled with hinges (not shown) to frame 112 and can be opened and closed through operation of operator mechanism 116. Locking system 111 includes keeper 138, tie bar 140 (FIG. 2), and rivet assembly 142 (FIG. 2), where tie bar 140 and rivet assembly 142 are concealed in frame 112. Openings 136 receive keepers 138, where keepers 138 are mounted on sash 114 as depicted.

Figure 2:
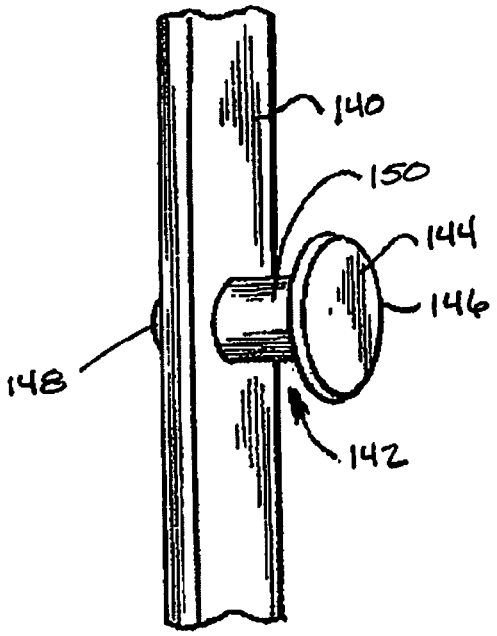
Fig. 2 Prior Art
FIG. 2 is an isometric view of a known tie bar and roller assembly.

FIG. 2 illustrates one example of a known tie bar 140 having rivet assembly 142. Tie bar 140 is mounted in frame 112 so that rivet assembly 142 is aligned with opening 136 of frame 112. Rivet assembly 142 includes rivet 144, head 146, shank 148 and sleeve 150. Further details of known tie bar assemblies are disclosed in U.S. Pat. No. 7,452,014, owned by the owners of the present invention, said patent being hereby fully incorporated herein by reference.

Figure 3:
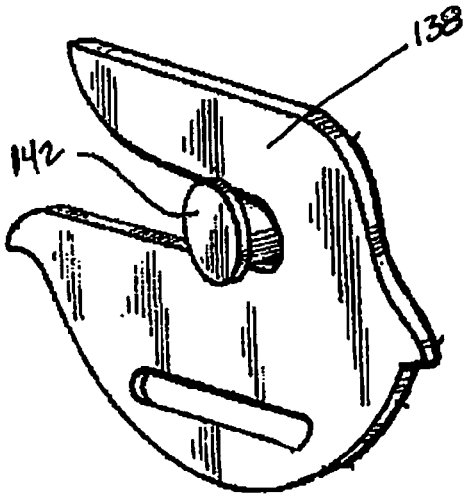
Fig. 3 Prior Art
FIG. 3 is an isometric view of a keeper and roller assembly in the locked position.
Figure 4:
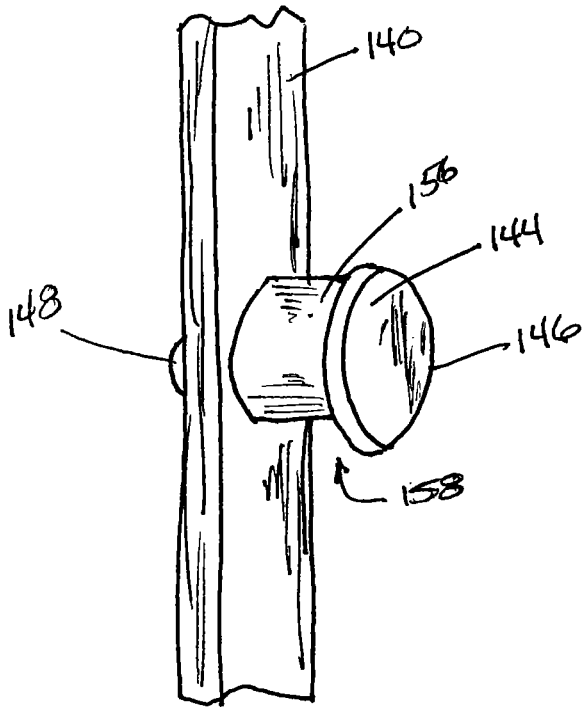
FIG. 4 is an isometric view of a tie bar and rivet assembly according to an embodiment of the invention.
Figure 5:
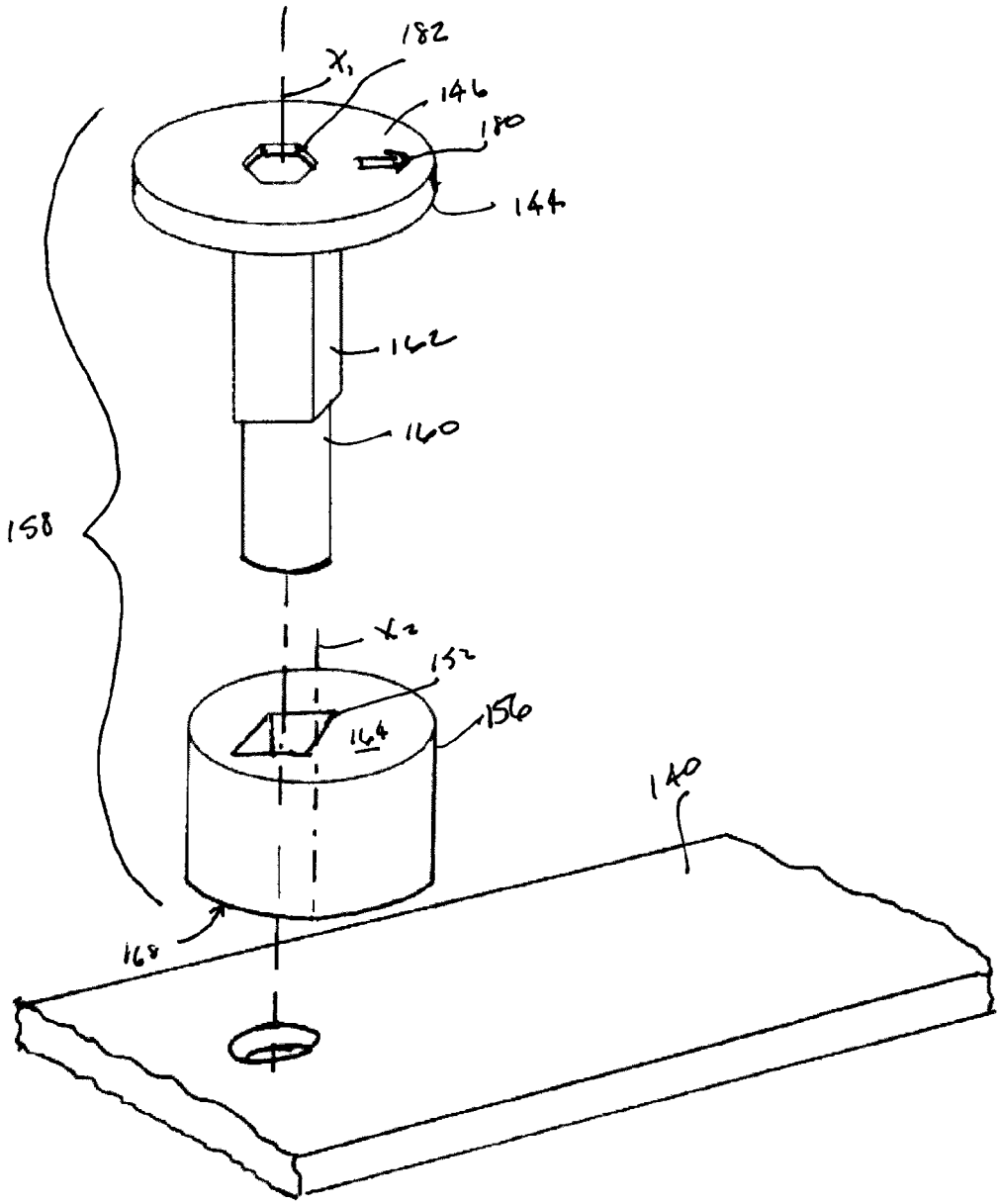
FIG. 5 is an exploded view of a rivet assembly and tie bar according to an embodiment of the invention.

FIG. 3 depicts one embodiment of keeper 138. It is known to those skilled in the art that keepers 138 come in a variety of shapes and sizes but perform similar functions. For simplicity, only one embodiment of keeper 138 is shown but it is apparent that other configurations of keepers 138 would perform the functions as intended. In the locked position, as shown in FIG. 3, keeper 138 partially surrounds and engages roller assembly 142 thus pulling-in and holding window sash 114 to window frame 112.

FIGS. 4-7 depict an embodiment of the invention with tie bar 140 having at least one attached rotatable rivet assembly 158. Rivet assembly 158 generally includes rivet 144 and sleeve 156. Rivet 144 generally includes head 146 and shank 148. Shank 148 may have a first portion 160 which is substantially cylindrical, and a second portion 162 which is square in cross-section. Shank 148 and head 146 are symmetrical about central axis $X_1$.

Sleeve 156 is substantially cylindrical with central axis $X_2$, and defines through hole 152. Through hole 152 is conformingly shaped with second portion 162 of shank 148, and is offset from central axis $X_2$. Shank 148 is received in through hole 152, with head 146 abutting top surface 164 of sleeve 156.

First portion 160 is received in hole 166 in tie bar 140 with bottom surface 168 of sleeve 156 abutting tie bar 140, and is spun into place so that rivet assembly 158 is permanently attached to tie bar 140, but is rotatable relative to tie bar 140. Hence, when positioned on shank 148, sleeve 156 is disposed between tie bar 140 and head 146 of rivet 144.

Notably, due to the square cross-section of through hole 152 and second portion 162 of shank 148, sleeve 156 is not rotatable on shank 148, but instead rotates with rivet 144. Sufficient friction is maintained in the interface between first portion 160 of shank 148 and hole 166 in tie bar 140 so that rivet assembly 158 is rotatable with a tool, but otherwise is maintained in a set position.

In use, rivet assembly 158 can be rotated to adjust for different keeper positions and to adjust the position of sash 114 relative to frame 112, when it is desired to pull sash 114 into closer engagement with frame 112 or enable greater clearance between sash 114 and frame 112. In this way, the seal between the sash and frame can be adjustably increases or decreases as desired.

Figure 6:
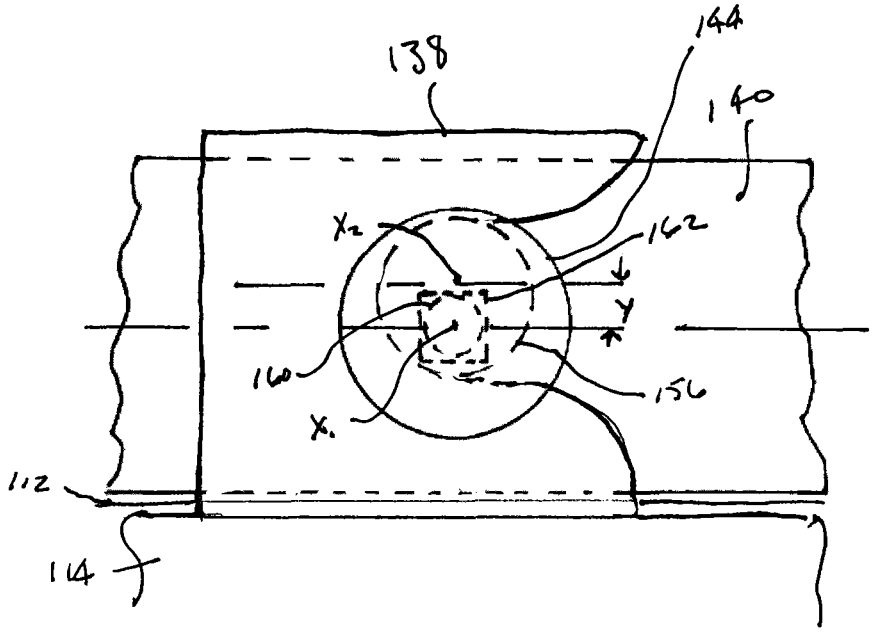
FIG. 6 is a top plan view of the rivet assembly and tie bar of FIG. 5, with the rivet assembly rotated to a first position and with the rivet assembly engaged with a keeper.
Figure 7:
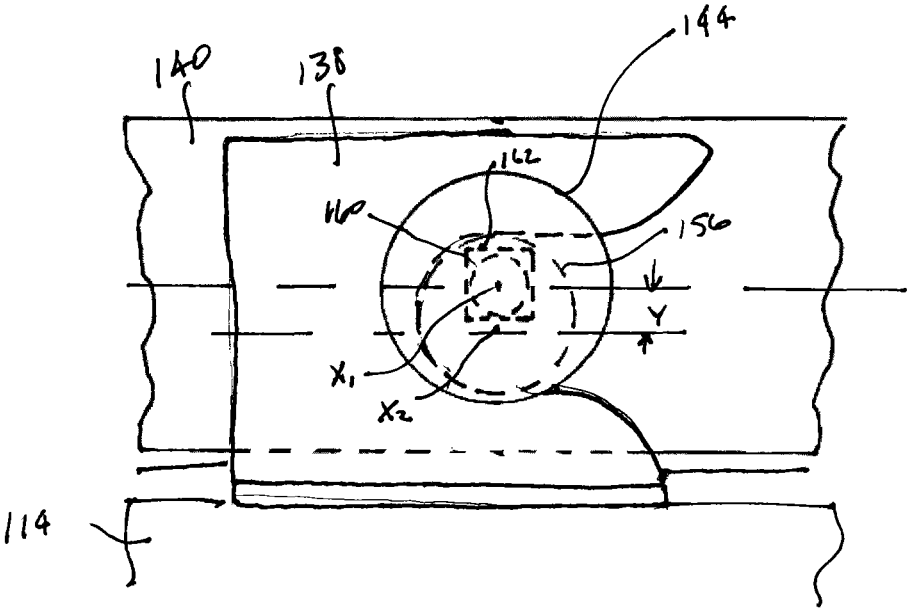
FIG. 7 is a top plan view of the rivet assembly and tie bar of FIG. 5, with the rivet assembly rotated to another position and with the rivet assembly engaged with a keeper.

As depicted in FIG. 6 for example, rivet assembly 158 is rotated so that central axis $X_2$ of sleeve 156 is offset a distance Y in one direction from longitudinal axis $X_3$ of tie bar 140, so that when rivet assembly 158 is engaged with keeper 138, sash 114 is pulled into closer engagement with the window frame 112. As depicted in FIG. 7, rivet assembly is rotated 180 degrees from the position depicted in FIG. 6, so that central axis $X_2$ of sleeve 156 is offset distance Y in the opposite direction from longitudinal axis $X_3$ of tie bar 140. In this position, when rivet assembly 158 is engaged with keeper 138, sash 114 has relatively greater clearance from window frame 112.

Although through hole 152 and second portion 162 of shank 148 are depicted as having a square cross-section, it will be appreciated that other shapes may be used that will function to prevent rotation of sleeve 156 on shank 148. For example, through hole 152 and second portion 162 may have other matching cross sections and shapes including, for example, star, square, hex, oval, triangular, or other polygonal shape.

In one embodiment, second portion 162 and through hole 152 are shaped so that they can only assemble in one orientation. In one embodiment, second portion 162 and through hole 152 are shaped so that the offset of sleeve 156 may be oriented to match an indicator mark 180 on head 146 of rivet 144, thereby providing a visual indication of the orientation of the offset of sleeve 156 when rivet assembly 158 is rotated.

Further, although head 146 of rivet 144 is depicted here as being round, head 146 can be shaped (square, hexagonal, etc.) to complement and mate with a wrench or other tool to enable rivet assembly 158 to be rotated. Alternatively, head 146 may be provided with a recess 182 having its geometric center on longitudinal axis x1. Recess 182 can be shaped to receive a tool that is inserted into recess to rotate rivet 144. Shaped recess can include, but is not limited to, a hex shape, a star shape, a torx shape, a spanner, an allen socket, a square shape, a cross shape, a Phillips, or a slot shape.

The embodiments above are intended to be illustrative and not limiting. Additional embodiments are encompassed within the scope of the claims. Although the present invention has been described with reference to particular embodiments, those skilled in the art will recognize that changes may be made in form and detail without departing from the spirit and scope of the invention. For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A casement window comprising:

a frame;

a sash operably received in the frame; and a lock assembly for locking the sash in the frame, the lock assembly comprising:

a tie bar operably coupled to the frame, the tie bar having a rotatable rivet assembly thereon, the rotatable rivet assembly including a rivet having a head portion and a shank portion, and a sleeve received on the shank portion, the sleeve having an outer surface being substantially cylindrical about a sleeve axis, the head portion and the shank portion of the rivet being symmetrical about a rivet axis, the shank portion received through an aperture in the sleeve so that the rivet axis is offset from the sleeve axis and the sleeve is rotationally and axially fixed relative to the rivet, wherein the rivet and the sleeve are rotatable together relative to the tie bar so as to shift an orientation of the sleeve relative to the tie bar, and wherein the outer surface of the sleeve does not extend beyond an outer perimeter of the head portion; and a keeper on the sash, the tie bar being selectively operable to engage the rivet assembly with the keeper to secure the sash to the frame.

2. The casement window of claim 1, wherein the shank portion has a polygonal cross-sectional shape and the aperture in the sleeve has a corresponding polygonal cross-sectional shape.

3. The casement window of claim 2, wherein the polygonal cross-sectional shape is a square.

4. The casement window of claim 2, wherein the polygonal cross-sectional shape is a hexagon.

5. The casement window of claim 1, wherein the head portion of the rivet is round.

6. The casement window of claim 1, wherein the head portion of the rivet is square.

7. The casement window of claim 1, wherein the head portion of the rivet is hexagonal.

8. The casement window of claim 1, wherein the head portion of the rivet has a recess for receiving a tool to rotate the rivet assembly.

9. A window lock assembly comprising:

a tie bar having a rotatable rivet assembly thereon, the rotatable rivet assembly including a rivet having a head portion and a shank portion, and a sleeve received on the shank portion, the sleeve having an outer surface being substantially cylindrical about a sleeve axis, the head portion and the shank portion of the rivet being symmetrical about a rivet axis, the shank portion received through an aperture in the sleeve so that the rivet axis is offset from the sleeve axis and the sleeve is rotationally and axially fixed relative to the rivet, wherein the rivet and the sleeve are rotatable together relative to the tie bar so as to shift an orientation of the sleeve relative to the tie bar, and wherein the outer surface of the sleeve does not extend beyond an outer perimeter of the head portion.

10. The window lock assembly of claim 9, wherein the shank portion has a polygonal cross-sectional shape and the aperture in the sleeve has a corresponding polygonal cross-sectional shape.

11. The window lock assembly of claim 10, wherein the polygonal cross-sectional shape is a square.

12. The window lock assembly of claim 10, wherein the polygonal cross-sectional shape is a hexagon.

13. The window lock assembly of claim 9, wherein the head portion of the rivet is round.

14. The window lock assembly of claim 9, wherein the head portion of the rivet is square.

15. The window lock assembly of claim 9, wherein the head portion of the rivet is hexagonal.

16. The window lock assembly of claim 9, wherein the head portion of the rivet has a recess for receiving a tool to rotate the rivet assembly.

* * * * *